US005257927A

United States Patent [19]

Lang

[11] Patent Number: 5,257,927

[45] Date of Patent: Nov. 2, 1993

[54] LOW $NO_x$ BURNER

[75] Inventor: Jerry M. Lang, Lindale, Tex.

[73] Assignee: Holman Boiler Works, Inc., Dallas, Tex.

[21] Appl. No.: 786,869

[22] Filed: Nov. 1, 1991

[51] Int. Cl.[5] ..... E23M 9/00

[52] U.S. Cl. ..... 431/184; 431/187; 431/189; 431/285; 431/354; 239/402.5

[58] Field of Search ..... 431/184, 181, 182, 187, 431/183, 278, 189, 115, 285, 354, 173; 239/402.5, 403–406

[56] References Cited

U.S. PATENT DOCUMENTS

| | | | |
|---|---|---|---|
| 1,920,186 | 8/1933 | Carter | 431/173 |
| 1,987,400 | 1/1935 | Hillhouse | 431/173 |
| 2,144,098 | 1/1939 | Baker | 431/184 |
| 2,210,428 | 8/1940 | Peabody | 431/121 |
| 2,247,768 | 7/1941 | Huwyler | 431/166 |
| 2,380,463 | 7/1945 | Poole | 431/184 |
| 2,660,230 | 11/1953 | Denker et al. | 431/164 |
| 3,391,981 | 7/1968 | Voorheis et al. | 431/184 |
| 3,615,249 | 10/1971 | Martois | 431/162 |
| 3,834,857 | 9/1974 | Hemingway et al. | 431/184 |
| 3,856,455 | 12/1974 | Otway et al. | 431/165 |
| 3,904,349 | 9/1975 | Peterson et al. | 431/184 |
| 3,918,886 | 11/1975 | Runninger | 431/184 |
| 3,932,110 | 1/1976 | Waddell | 431/184 |
| 4,004,875 | 1/1977 | Zink et al. | 431/184 |
| 4,007,001 | 2/1977 | Schirmer et al. | 431/165 |
| 4,013,399 | 3/1977 | Craig et al. | 431/160 |
| 4,106,890 | 8/1978 | Fulmer et al. | 431/184 |
| 4,141,505 | 2/1979 | Reich | 239/431 |
| 4,144,017 | 3/1979 | Barsin et al. | 431/174 |
| 4,217,132 | 8/1980 | Burge et al. | 431/9 |
| 4,257,762 | 3/1981 | Zink et al. | 431/187 |
| 4,347,052 | 8/1982 | Reed | 431/188 |
| 4,350,103 | 9/1982 | Poll | 110/264 |
| 4,389,185 | 6/1983 | Alpkvist | 431/164 |
| 4,403,941 | 9/1983 | Okiura et al. | 431/174 |
| 4,412,810 | 11/1983 | Izuha et al. | 431/187 |
| 4,504,216 | 3/1985 | Hagar et al. | 431/188 |
| 4,531,904 | 7/1985 | Sato et al. | 431/187 |
| 4,551,090 | 11/1985 | Leikart et al. | 431/188 |
| 4,572,084 | 2/1986 | Green et al. | 431/187 |
| 4,575,332 | 3/1986 | Oppenberg et al. | 431/188 |
| 4,597,342 | 7/1986 | Green et al. | 431/183 |
| 4,602,571 | 7/1986 | Chadshay | 431/188 |
| 4,626,195 | 12/1986 | Sato et al. | 431/188 |
| 4,629,413 | 12/1986 | Michelson et al. | 431/188 |
| 4,718,359 | 1/1988 | Skoog | 431/184 |
| 4,728,285 | 3/1988 | Kamelreiter et al. | 431/187 |
| 4,836,772 | 6/1989 | LaRue | 431/187 |
| 4,915,619 | 4/1990 | LaRue | 431/187 |
| 4,925,387 | 5/1990 | Locaneto et al. | 431/187 |
| 4,983,118 | 1/1991 | Hovis et al. | 431/115 |
| 5,145,359 | 9/1992 | Ancona et al. | 431/184 |

*Primary Examiner*—James C. Yeung

*Attorney, Agent, or Firm*—Edgar A. Zarins; Malcolm L. Sutherland

[57] ABSTRACT

A low $NO_x$ burner combustion system which may be adjusted for optimum burn rates, temperature and oxygen levels. The burner incorporates a plurality of gas nozzles which individually inspirate a portion of the combustion air and a spin vane diffuser to rotate and mix the gases within the primary combustion zone. The diffuser is axially adjustable in order to vary the distance between the vane and the first combustion zone while the blades of the diffuser can be angularly adjusted to optimize the rotation and mix of the gases. Air for combustion is supplied through primary, secondary and tertiary passages to create distinct combustion zones for complete combustion. The flow rate of the combustion air is controlled through a damper in accordance with the burn characteristics. The angular and axial position of the diffuser and the damper control of combustion air can be automatically adjusted throughout the firing range of the burner in response to demand levels. In order to convert existing burners to the efficient low $NO_x$ burner of the present invention the primary air chamber may be retrofit into the main burner chamber. In a further embodiment, flue gas is recirculated and mixed directly with combustion fuel prior to combustion for reduced emission levels.

29 Claims, 7 Drawing Sheets

LOW $NO_x$ BURNER

BACKGROUND OF THE INVENTION

1. Field of the Invention

This invention relates to a burner having reduced $NO_x$ emissions and, in particular, to a burner wherein flow and mix rates may be varied in accordance with the combustion characteristics and demand rate of the burner. The specific adjustments of an existing burner may be retrofitted to vary for optimization with demand.

2. Description of the Prior Art

Combustion system burners have come under increased scrutiny for the toxic emissions which are a by-product of the combustion process. Depending upon the extent of combustion, carbon monoxide and $NO_x$ may be omitted at unacceptable levels. Carbon monoxide levels can normally be controlled through complete combustion resulting in carbon dioxide. However, three factors contribute to the formation of $NO_x$ in combustion systems. The first and most widely recognized is flame temperature. Most current systems incorporate some method of staging fuel and air to reduce flame concentration and resultant high temperatures. A second factor is excess $O_2$ levels. Higher $O_2$ levels tend to provide more oxygen for combination with nitrogen; however, the higher $O_2$ levels results in excess air which tends to balance the effect of lower temperatures. The laminar mix in most current low $NO_x$ burners requires more $O_2$ for complete combustion. If lower $O_2$ levels are utilized the result is incomplete combustion in the form of carbon monoxide. The third factor is residence time in a critical temperature zone which is virtually ignored in modern burners because reduced time means higher velocities producing unacceptable temperatures.

One common practice for reducing $NO_x$ levels is to use external, induced or forced flue gas recirculation (FGR). A common misconception about FGR is that the process is destroying $NO_x$ in the original flue gas. However, recent research has determined that FGR simply reduces or dilutes the flame front thereby reducing the formation of $NO_x$. Further, external flue gas recirculation results in higher temperature and increased volume combustion air producing higher pressure drops through the system requiring more horsepower, the resultant higher velocities also reducing heat transfer thereby reducing the efficiency of the burner.

Several burner manufacturers have developed low $NO_x$ systems with mixed results. Although $NO_x$systems emissions have been reduced many of the systems do not meet the stringent emission levels. Moreover, the modern burners are specifically designed for the particular application and will not control emissions in different combustion systems or under different conditions because of their inflexibility. An additional drawback in prior known systems, as $NO_x$ emissions were reduced the carbon monoxide (CO) levels would increase.

SUMMARY OF THE PRESENT INVENTION

The present invention overcomes the disadvantages of the prior known burner systems by providing a low $NO_x$ burner with an adjustable design for application in many different systems and in response to different operating conditions. As a result the burner of the present invention may be installed as a retro-fit adapter for existing burner systems.

The low $NO_x$ burner of the present invention includes a plurality of coaxial passageways through which combustion gases flow. Primary air flows through an inner passageway within which a spin vane is positioned. The spin vane may be axially adjusted to optimize combustion. The flow of primary air from the forced air windbox into the burner is controlled by a damper having adjustable louvers to further improve combustion. As the primary air passes through the vane, it is caused to spin and mix with the fuel supplied through a series of eductor nozzles radially spaced about the primary combustion zone. The nozzles mix the fuel with secondary combustion air from the windbox prior to eduction into the combustion chamber. Alternatively, recirculated flue gas may be mixed with the fuel in the eductor nozzles. A chamber throat formed of refractory materials forms a secondary combustion zone where reradiation from the refractory throat heats the fuel/air mix and speeds the burning process. A final tertiary burn takes place in a tertiary combustion zone beyond the refractory throat where laminar mixing occurs as a result of the tertiary air supply which bypasses the initial combustion zones. Thus, three distinct combustion zones and two recirculation areas are produced resulting in low $NO_x$ emissions.

In a retrofit conversion of existing burners, the same principles are applied in order to optimize combustion and reduce $NO_x$ emissions. A primary combustion chamber with an adjustable vane diffuser is coaxially installed within the combustion chamber of the existing burner thereby forming an annulus for the supply of secondary air within which the existing fuel spuds are located. The spin vane is axially and angularly adjustable to optimize combustion. In addition, a fuel manifold spider arrangement which directs the fuel gas inwardly towards the primary combustion chamber is provided to facilitate optimum mixing of fuel and air. Primary air is again spun by the adjustable vane diffuser to create an optimum air/fuel mix for primary combustion. Secondary air passes through the fuel manifold for mix and combustion in the secondary combustion zone downstream of the primary combustion zone.

The present system reduces $NO_x$ emissions without the trade off of increased CO emissions of prior known burners by optimizing the volume and mix of combustion air to the staged combustion zones. In turn, the burn temperature and residence time of the combustion gases are controlled through the various adjustments of the burner system. Accordingly, $NO_x$ emission levels are reduced by controlling the $O_2$ levels within the combustion zones, temperature of the recirculated combustion gases and residence time within burner. These parameters are controlled by varying the pitch angle of the diffuser blades, the length of the chamber from the vane diffuser to the fuel jets, and the ratio of primary combustion air flowing through the central passage to secondary and tertiary (if present) combustion air flowing to subsequent combustion zones. In addition, the present system includes internal flue gas recirculation which maintains the temperature of the recirculated gases while ensuring complete combustion.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
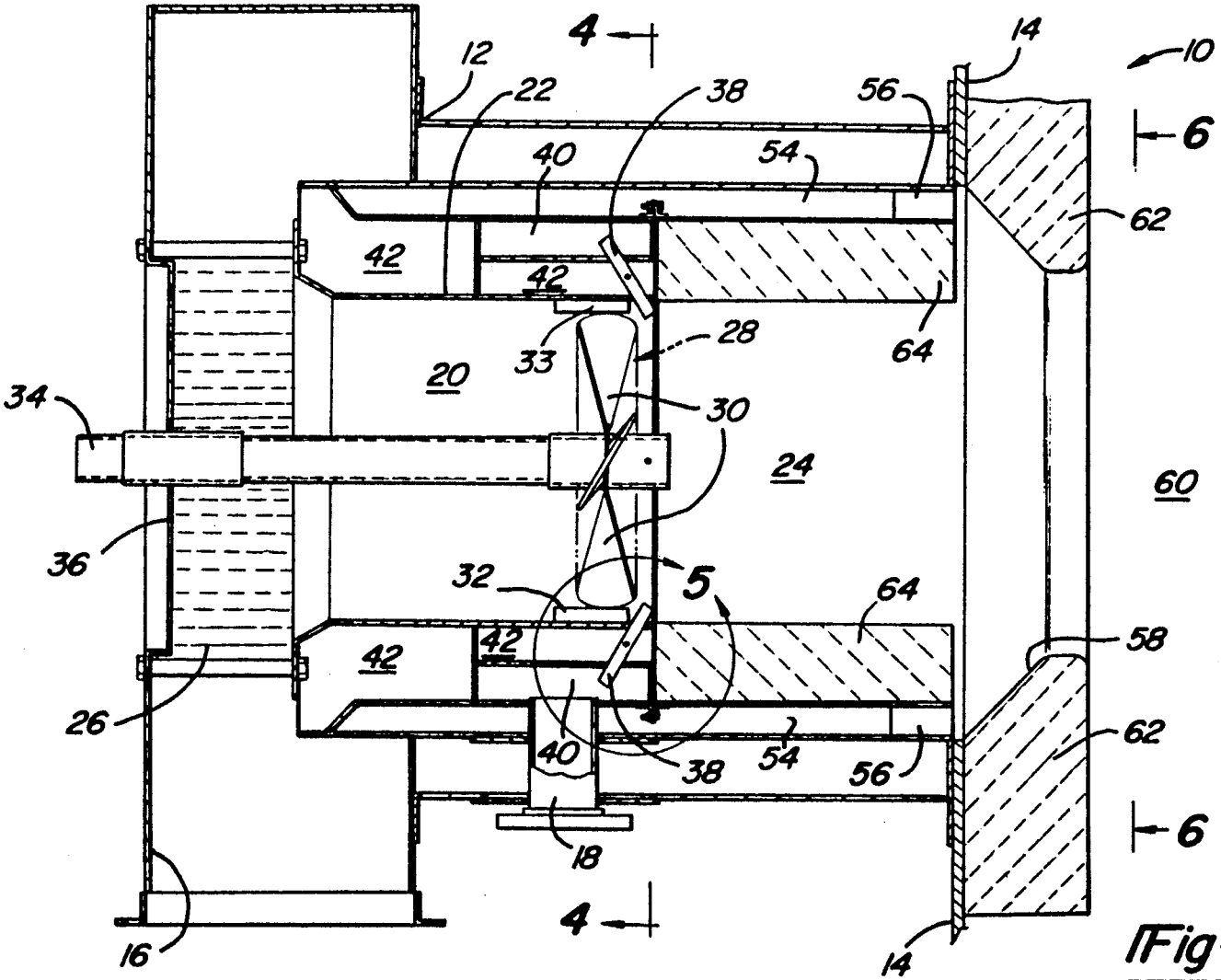
FIG. 1 is a cross-sectional perspective of a low $NO_x$ burner embodying the present invention.
Figure 2:
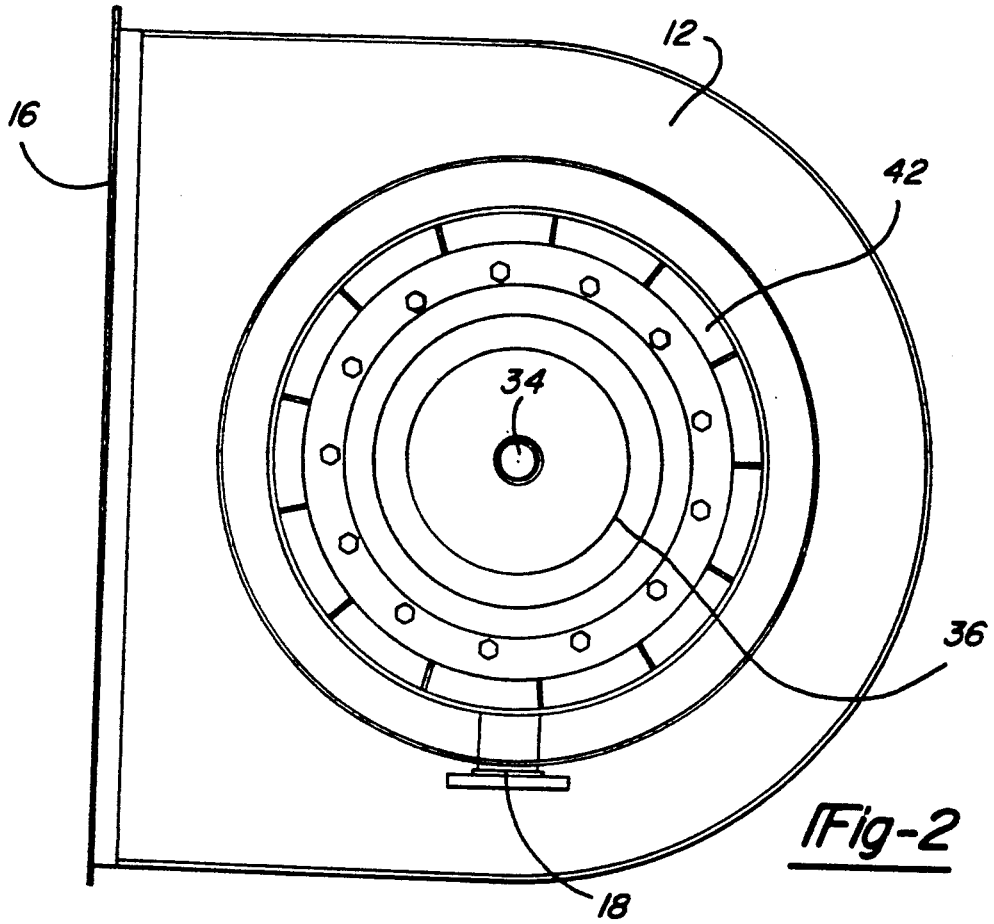
FIG. 2 is an end view thereof.
Figure 3:
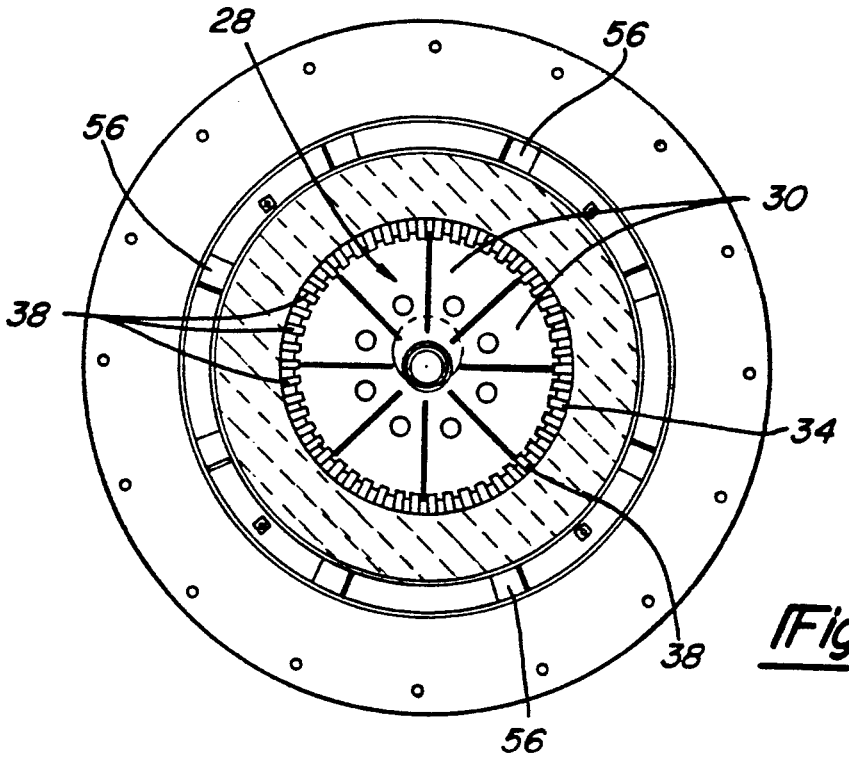
FIG. 3 is a lateral cross-section taken along lines 3—3 of FIG. 1.
Figure 4:
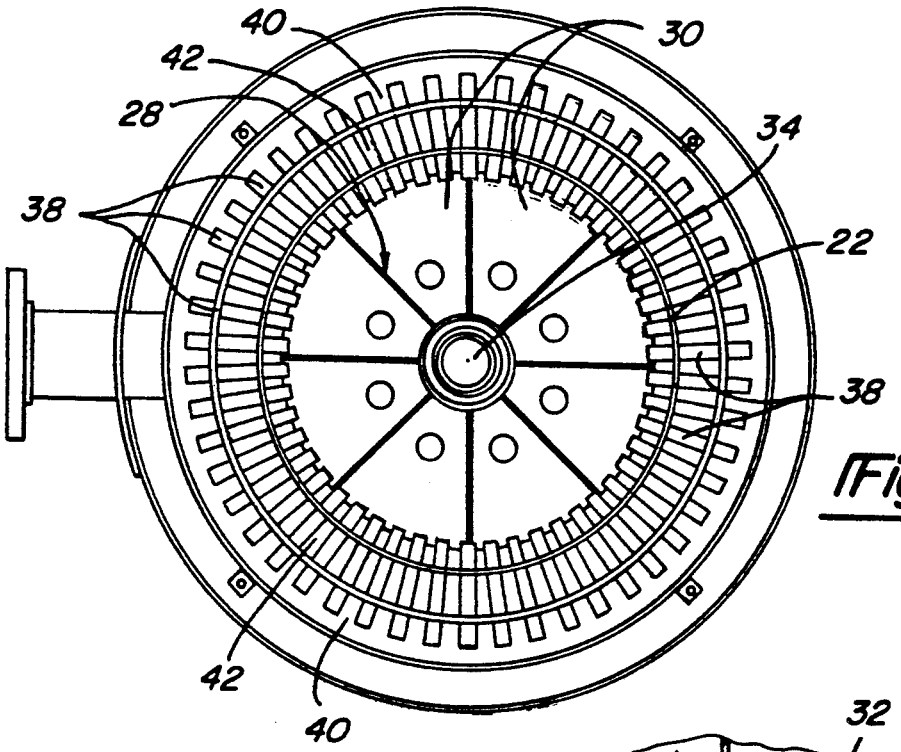
FIG. 4 is a lateral cross-section taken along lines 4—4 of FIG. 1.
Figure 10:
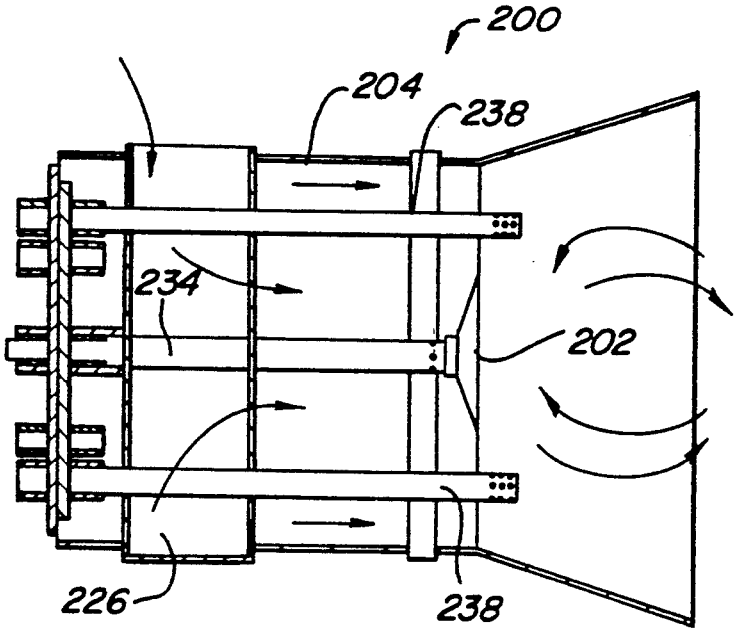
FIGS. 10 and 11 depict a cross-sectional perspective of a still further embodiment of the retrofit low $NO_x$ burner of the present invention.
Figure 9:
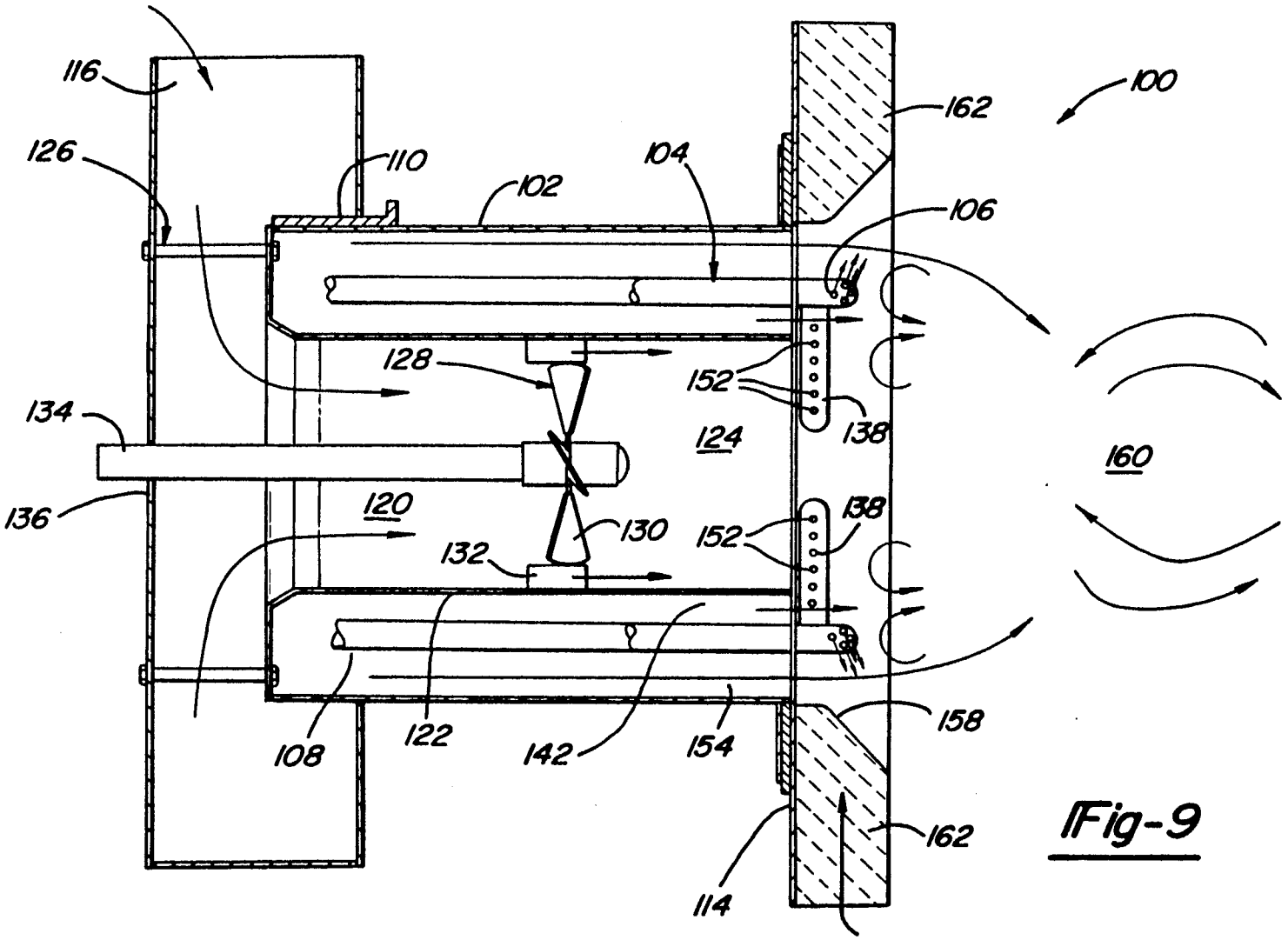
FIG. 9 is a cross-sectional perspective of a further embodiment of the low $NO_x$ burner of the present invention.
Figure 11:
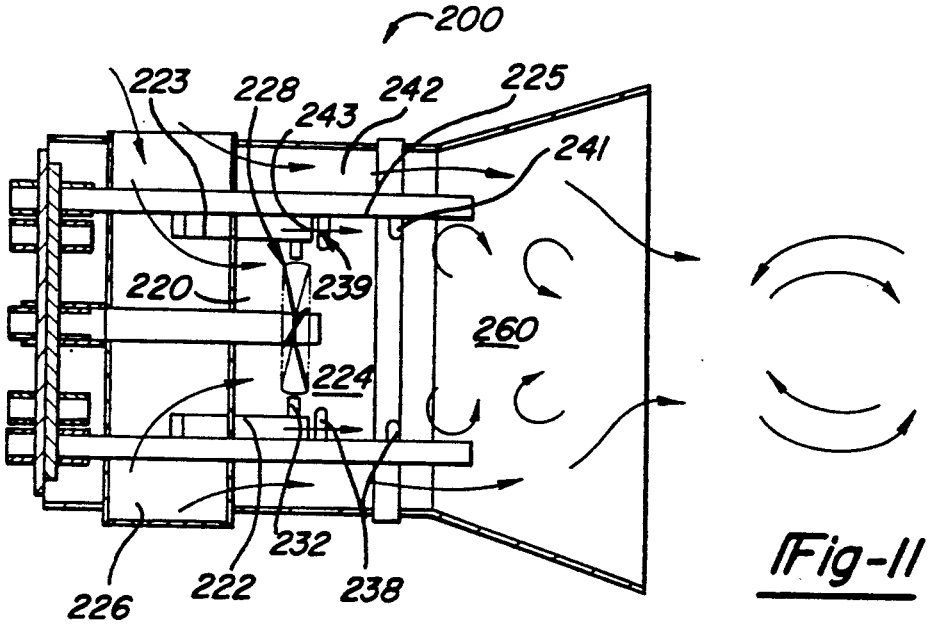

Referring to the drawing, there is shown several embodiments of a low $NO_x$ burner in accordance with the present invention. FIG. 1 shows a high efficiency, low $NO_x$ emission burner 10 of original construction while FIGS. 9-11 show a retrofit burner 100 which converts a well-known, conventional burner to a high efficiency, low $NO_x$ emission burner as embodied by the principles of the present invention. With the advent of stricter emission standards for all types of combustion systems, the elimination or reduction of noxious emissions such as $NO_x$ and CO becomes increasingly important. The embodiments of the present invention provide a high-efficiency burner whereby flame temperature, burn rate, etc. are strictly controlled yet undesirable emissions are substantially reduced through the precise adjustment of the fuel/air mix according to the parameters of the combustion system. The present invention facilitates automatic adjustment of the burner in accordance with the specific combustion system and its rate.

Referring first to FIGS. 1 through 6, the burner 10 of the present invention includes an outer housing 12 adapted to be bolted or welded to a wall 14 of a boiler or similar structure. Supplied to the burner 10 through duct 16 is combustion air from a forced-air windbox and through pipe 18 combustion fuel such as refinery or natural gas. While the combustion fuel is supplied directly to the interior combustion zones of the burner 10, the combustion air may flow through primary, secondary and tertiary paths to facilitate complete combustion.

The primary air flow is directed through a central passage 20 formed by an inner cylindrical housing 22. The central passage 20 communicates with the combustion air duct 16 at one end and with a primary combustion zone 24 at its other end. In order to control the flow of combustion air into the central passage 20, a damper 26 with selectively adjustable louvers is positioned at the entrance to the central passage 20. The damper 26 may be selectively adjusted to control the volume of flow not only through the primary air path but also through the secondary and tertiary air paths. Since the combustion air flow through the duct 16 is substantially constant reduction of flow into the primary path will divert flow to the secondary and tertiary paths. Positioned within the central air passage 20 is a diffuser 28 having a plurality of vane blades 30 for imparting a mix rotation on the combustion air flowing therethrough. The vane diffuser 28 is seated between diffuser guides 32 radially spaced about the housing 22. An axial rod 34 is connected to the hub of the diffuser 28 and extends to the exterior of the burner 10 through an end wall 36. Accordingly, primary air flow will travel through the diffuser 28 and past the diffuser 28 through the annulus 33 between the blades 30 and the housing 22. The size of this annulus 33 is specifically sized to create an area of reduced pressure along the housing 22 which prevents disruption of the rotational swirl caused by the vane diffuser. The diffuser 28 is not fixed within the central passage 20 but may be axially adjusted through manipulation of the diffuser rod 34. The axial position of the diffuser 28 and the pitch angle of the blades 30 will determine the mix rotation of the primary air as it enters the primary combustion zone 24. The adjustable diffuser 28 facilitates production of an optimum low pressure zone behind the flame front to promote maximum recirculation within the combustion zone 24.

Figure 5:
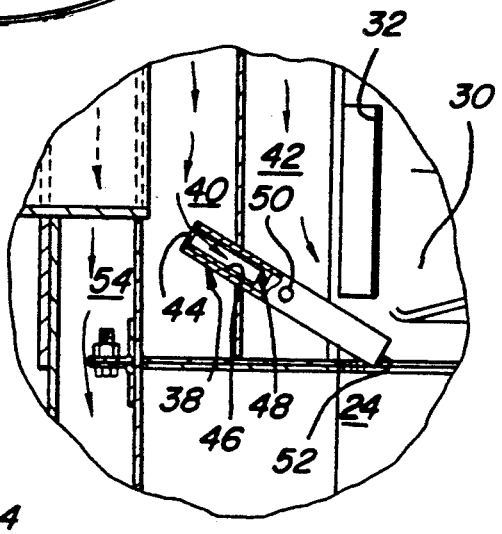
FIG. 5 is an enlarged view taken of circle 5 in FIG. 1.
Figure 6:
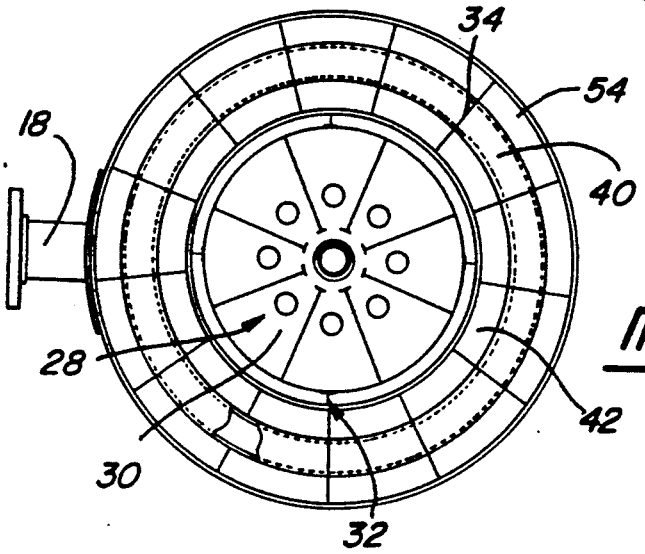
FIG. 6 is an end view taken along lines 6—6 of FIG. 1.
Figure 7:
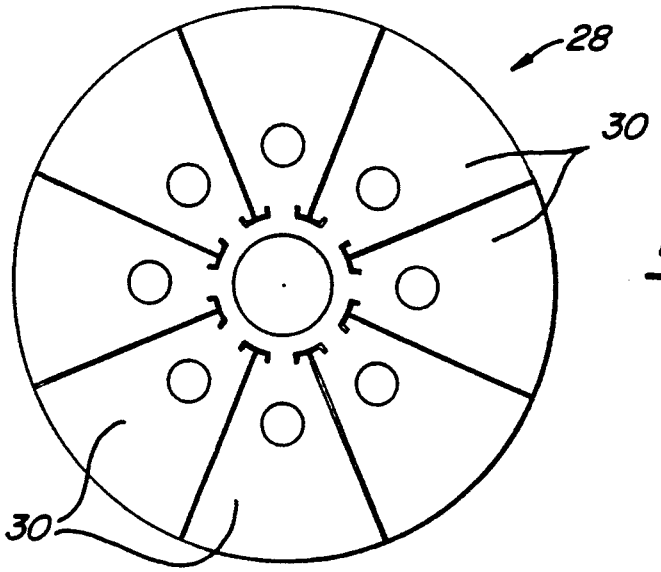
FIG. 7 is a plan view of the spin vane employed in the present invention.
Figure 8:
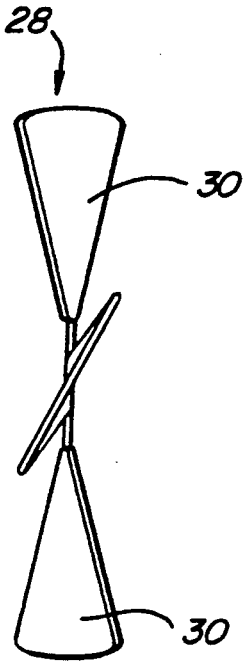
FIG. 8 is a side view of the spin vane.

Fuel and secondary air are supplied to the combustion chamber 24 through a plurality of eductor nozzles 38 radially mounted within the housing wall 22 of the central passage 20 so as to direct the fuel/air mix into the combustion chamber 24. Fuel from the pipe 18 flows into annular chamber 40 so as to feed all of the nozzles 38. Secondary combustion air flows from the windbox duct 16 into annular chamber 42 formed coaxial with the central passage 20. As best shown in FIG. 5, fuel under pressure flows into a first end 44 of the nozzle 38 which includes a replaceable restrictor 46 having a port 48. It is anticipated that a restrictor 46 would be selected with the desired port 48 in order to optimize the mix of fuel and air within the nozzle 38. The combustion air from the forced air windbox enters the nozzle through one or more lateral ports 50 which communicate with the chamber 42. Thus, the fuel and air mix within the nozzle 38 through the jet action of the fuel creating a Venna-contraction at the air intake of the nozzle 38 and are exhausted through the second end 52 of the nozzle 38 into the chamber 24 where combustion occurs.

Tertiary air circumvents the initial combustion zones flowing through outer annular chamber 54 which communicates with the duct 16 and the end of the burner 10. Disposed within the outlet end of the chamber 54 are a plurality of support guides 56 which are angled in order to impart a rotational mix on the tertiary air as it exits the chamber 54 and enters a refractory throat 58 and the final combustion zone 60. The refractory throat 58 is formed by refractory materials 62 which constrict the flow and recirculate the gases for complete combustion.

Similarly, the inner combustion chamber 24 is lined with refractory materials 64. The refractory material radiates heat from combustion thereby heating incoming and recirculated combustion air to increase the rate of burn.

In addition to the manufactured burner 10, the principals of the present invention can be retrofit to existing burners to convert to a low $NO_x$ burner 100 as shown in FIGS. 9–11. The conventional, prior known burner includes a burner housing 102 which is bolted or welded to the wall 114 of the boiler so as to direct the combustion flame towards the boiler. A plurality of radially-spaced fuel spuds 104 extend longitudinally through the housing 102 to approximately the refractory throat 158. The fuel spuds 104 include fuel ports 106 from which fuel is exhausted into the combustion chamber 124 where it is mixed with air and burned.

The retrofit conversion consists of installing a secondary housing 122 coaxially within the main housing 102 forming a central passage 120 and an annular chamber 108. The insert 122 includes damper 126 to control the volume of combustion air flowing into the central passage 120. Similarly, slide ring 110 controls the flow of air into chamber 108 in accordance with the damper 126—as flow is restricted through the damper 126 an increased flow of combustion air will be directed to the annular chamber 108. Disposed within the central air passage 120 is a spin diffuser 128 having a plurality of vane blades 130. The diffuser 128 is seated between guides 132 and is axially adjustable to optimize combustion while reducing noxious emissions. In addition, the blades 130 of the diffuser 128 may be angularly adjusted to impart an optimum rotational mix on the air flowing through the central passage 120. The adjustable spin diffuser 128 facilitates production of an optimum low pressure zone behind the flame front to promote maximum recirculation within the burner 100.

In order to bring the fuel into contact with the primary combustion air flowing through the central air passage 120, the original fuel spuds 104 are provided with an inwardly directed gas manifold 138 having a plurality of ports 152 directing fuel into the combustion chamber 124 downstream of the diffuser 128. The secondary combustion air will flow through the outer annular chamber 108 past the ends of the fuel spuds 104. A portion of the secondary air will recirculate into the combustion flame while the remaining air will flow past the spuds 104 to the final combustion zone 160 beyond the refractory throat 158. In this construction, the primary flame front will be produced within the housing 122 in the combustion zone 124 and will be substoichiometric reducing atmosphere designed to eliminate oxygen needed to form $NO_x$. Combustion will be completed downstream in the cooler combustion zone 160.

The described retrofit system 100 has been shown to reduce $NO_x$ levels to 40 ppm without flue gas recirculation and to approximately 25 ppm with flue gas recirculation. This is from initial levels of approximately 55 ppm to 65 ppm. Either system produces distinct mixing areas with staged combustion zones, adjustment of the proportions of primary, secondary and tertiary air using a single damper, and creation of an optimum low pressure zone behind the flame front through adjustment of the diffuser 28,128. The diffuser 28,128 can be adjusted either by adjusting the angle of the vanes 30,130 or by axially adjusting the position of the diffuser 28,128 relative to the fuel jets 38,138. Adjustment of the diffuser 28,128 is designed to control the time the combustion air and fuel are in the combustion chamber. The diffuser vanes 30,130 are proportioned relative to the diameter of the central air passage 20,120 such that a rotational mix is imparted on the gases causing one complete rotation prior to reaching the combustion zone thereby reducing oxide production by controlling the time the fuel remains in the combustion zone. The adjustments control the length of the chamber between the diffuser Vane 28,128 and introduction of combustion fuel 38,138 relative to the diameter of the central air passage 20,120 (length/diameter). The vane pitch and axial position of the diffuser 28,128 are adjusted such that the swirl or rotation of the primary air is less than one complete revolution prior to reaching the jets 38,138 (optimally 0.6 revolutions) to ensure complete combustion. If rotation of the combustion air is too fast, excess air will move through the combustion zone allowing the formation of $NO_x$ since the velocity of the air is faster than it can be burned. Additionally, with too much spin, the flame can be drawn back towards the fuel supply resulting in an explosion or a meltdown of the fuel spuds. Similarly, the damper 26,126 controls the supply of air flowing to the combustion zone 24,124 in order to maintain the combustion zone at stoichiometric thereby reducing the $O_2$, and the creation of nitrous oxides.

Figure 12:
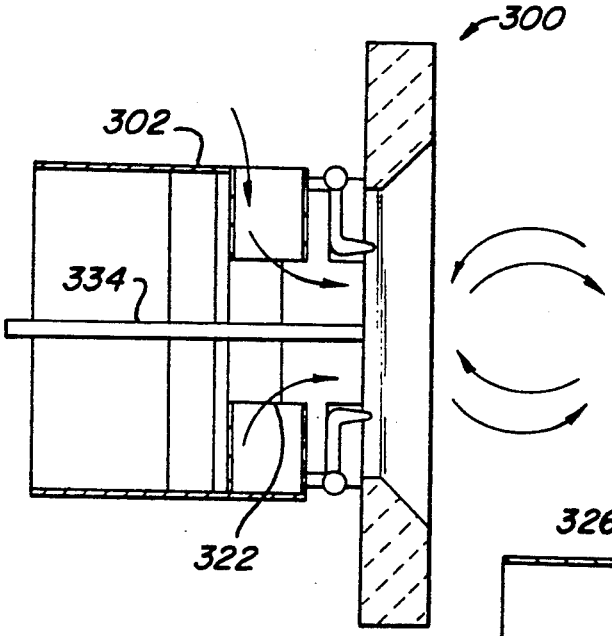
FIGS. 12 and 13 illustrate a cross-sectional perspective of an additional embodiment of the retrofit low $NO_x$ burner of the present invention.
Figure 13:
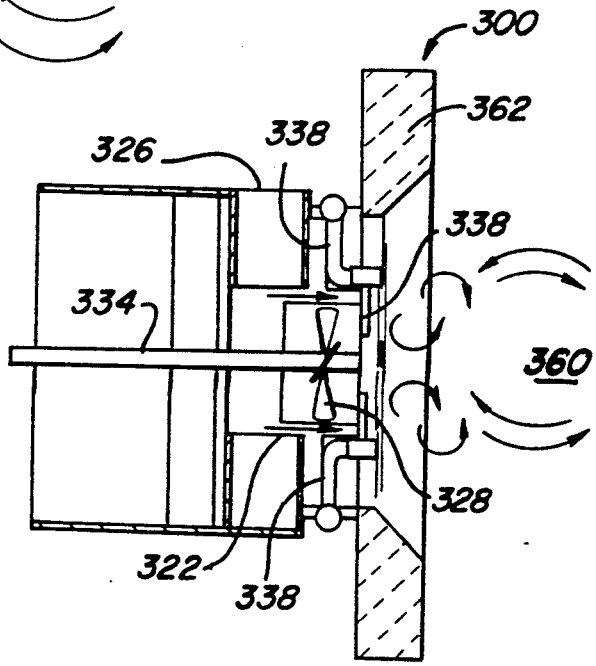

FIGS. 10–13 show still further embodiments of retrofit low $NO_x$ burners depicting conversion of well-known conventional burners. FIGS. 10 and 11 illustrate a retrofit conversion of a burner 200 commonly known as a "Zurn Burner". FIGS. 12 and 13 illustrate the retrofit of a burner 300 known as a "Coen Burner". Both provide further examples of retrofit systems which may incorporate the principles and features of the present invention.

Referring now to FIGS. 10 and 11, the burner system 200 includes a series of fuel spuds 238 and an air mixer 202 mounted to a shaft 234. Combustion air is introduced to the single chamber 204 through an air flow control damper 226. Conversion of this system to a low $NO_x$ burner requires the installation of an inner core chamber 222 to form a central air passage 220 and outer annular chamber 242. In this conversion, the inner chamber 222 includes a first wall 223 and a greater diameter second wall 225. In addition, a vane diffuser 228 is adjustable installed within the wall 223 with annular space 232 and multiple fuel manifolds 239 and 241 are attached to the fuel spuds 238. The manifolds 239,241 direct fuel to the individual combustion zones of the converted burner 200. In this system 200, combustion air from the damper 226 flows into both the central air passage 220 and the outer annular passage 242. Primary air flows through the passage 220 wherein the spin diffuser 228 inputs the rotational mix. Secondary air flows through the space 243 between first and second walls for secondary mix and combustion. Tertiary air flows to the outside of the inner core 222 for mix and combustion in a tertiary combustion zone 260. Because the Zurn burner 200 is a high hydrogen fuel burner, fuel is delivered directly to the combustion zones for complete combustion. As with the other embodiments, the angular and axial position of the diffuser 228 and the mix of combustion air are controlled to reduce $NO_x$ emissions.

As shown in FIGS. 12 and 13, the Coen burner 300 includes a main chamber 302 and an inner core 322. Fuel spuds 338 direct fuel to the combustion zone. Conversion requires installation of a vane diffuser 328 which can be axially and angularly adjusted and a spider manifold 338 mounted to the fuel spuds. In this manner, proper mix of the combustion air is imparted by the diffuser 328 while fuel is directed inwardly by the manifold 338.

Figure 14:
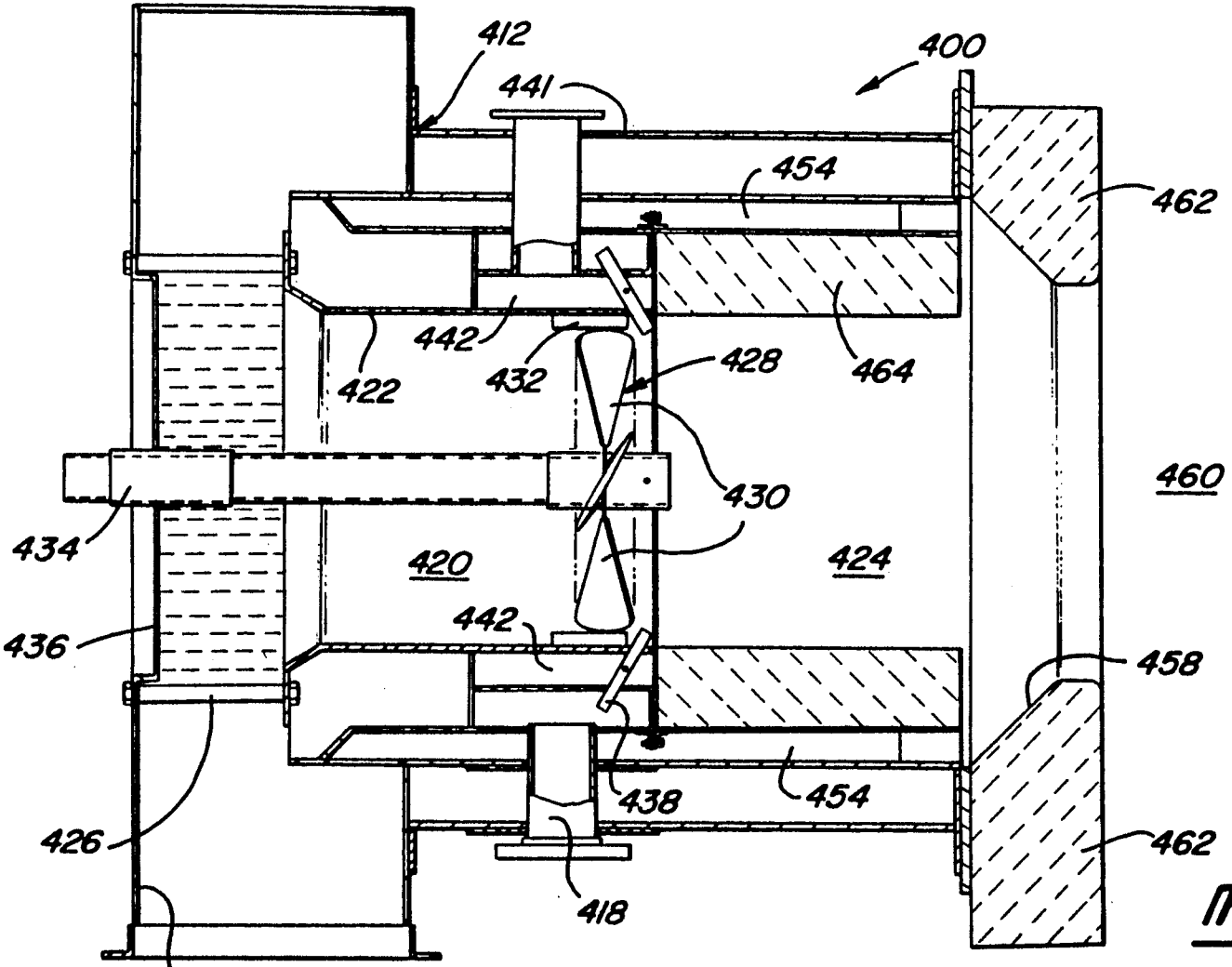
FIG. 14 is a cross-sectional perspective of another embodiment of the low $NO_x$ burner incorporating flue gas recirculation for improved flame dilution and temperature.

FIG. 14 shows another burner 400 embodying the present invention which recirculates flue gas for induction and mix with the fuel in the eductor nozzles 438. As a result, flue gas is forceably recirculated for mix directly with the combustion fuel resulting in improved flame dilution and temperature reduction. Under typical flue gas recirculation systems, a 20% recirculation of flue gas results in flame dilution and temperature reduction of approximately 7%. In contrast, a 5% recirculation with the system 400 results in dilution levels of 8–9%. In the induced recirculation system 400 of FIG. 14, the port 450 of the eductor nozzles 438 communicates with the chamber 442. Flue gas from the combustion zone 424 is recirculated into the chamber 442 through duct 441. Fuel flows into the end 444 of the nozzles 438 from the chamber 440 which communicates with the pipe 41. In this manner, as combustion fuel is forced into the nozzles 438, recirculated flue gas will be drawn into the nozzles 438 and mixed with the combustion fuel prior to combustion as the mix flows from the eductor nozzles. As an alternative, ambient air may be supplied to the chamber 442 for mix with the combustion fuel similar to the forced air system of the first embodiment. This principal of mixing recirculated flue gas with fuel prior to combustion may also be applied to the retrofit systems by inducing this mix before the fuel reaches the burner the burner. A venturi arrangement may be incorporated into the fuel line for inducing the preferred mix.

The adjustable aspects of the burner system of the present invention are designed to be adjusted for the specific combustion system being employed. The diffuser vane angle, the axial position of the diffuser, and the damper opening can all be individually set in accordance with known parameters of the burner system, namely fuel type, desired temperature, burn rate, etc. This is particularly significant in the retrofit conversion system where the operating parameters have been established. In the present invention, primary combustion occurs at the fuel nozzles 38,138 where initial mix of fuel and air occurs. The products of the primary combustion, which is approximately 60% combustible, enter the refractory lined combustion zone 24,124 where further mix occurs with combustion air from the central air passage 20,120 and the diffuser 28,128. A secondary burn is accomplished in this highly controlled area where the reradiation from the refractory heats the products thereby speeding the burning process which consumes approximately 80% of the remaining combustible products. A final tertiary burn takes place in the furnace area where laminar mixing occurs. Thus, the system produces three distinct combustion zones and recirculation in two areas with resultant low $NO_x$ emissions. The distinct combustion zones are created through the creation of low pressure areas within the burner, namely directly downstream of the vent diffuser 28,128 and at the exhaust of the circumventing air. The low pressure area proximate the diffuser is affected by the pitch of the vane blades 30,130—as the vane diffuser is opened the pressure behind the flame is reduced. This requires adjustment of the ratio of primary to secondary or tertiary air through use of the damper 26,126. It is desirable to optimize this ratio to control the air flowing into the burner thereby controlling the $O_2$ levels to produce optimum combustion without excess for the production of $NO_x$ emissions.

The several adjustments of the burner system of the present invention creates a $NO_x$ trim system wherein the emission levels can be optimally controlled along the complete range of demand levels of a modulating burner. The $NO_x$ trim system automatically adjusts the angular and axial position of the vane diffuser to vary the swirl number of the combustion air mix, the ratio of core air to annular air and the $O_2$ levels in the burner across all the demand levels of the burner. These adjustments may be optimally determined across all demand levels of the burner such that as these levels are attained the trim system automatically adjusts the components of the system to reduce emission levels. Typical prior known burners have their emission levels set for operation in a nominal operating range sacrificing emission levels when demand levels fall outside of this range. The several adjustments of the present invention allows continuous automatic control of emission levels at all operating demand levels. Modern burners require continuous monitoring of $NO_x$ levels from the burner. The data from these monitoring systems can be utilized to automatically adjust the $NO_x$ trim system according to the present invention.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a burner adapted to reduce emission of $NO_x$ gases upon combustion of a fuel and air, the burner including a source of combustion air and a source of combustion fuel, at least a portion of the combustion air flowing through a central air passage into which the combustion gas is supplied for combustion in a primary combustion zone, the improvement comprising:

a plurality of eductor nozzles radially spaced about the central air passage for supplying combustion fuel to the central air passage, said eductor nozzles mixing secondary combustion air with combustion fuel prior to flow into said primary combustion zone;

a vane diffuser positioned within the central air passage for imparting a mix rotation on the combustion air flowing through the central air passage thereby optimizing mix of combustion gas and combustion air for combustion in the burner; and means for controlling the volume of flow of combustion air into the central air passage for optimum combustion and reduction of $NO_x$ emissions.

2. The improvement as defined in claim 1 wherein said vane diffuser includes a plurality of blades, the pitch angle of said blades being adjustable to optimize mix rotation of combustion air for combination with combustion gas.

3. The improvement as defined in claim 2 wherein said vane diffuser is axially adjustable within the central air passage to vary the distance between said vane diffuser and the primary combustion zone.

4. The improvement as defined in claim 3 wherein said secondary combustion air is mixed with combustion fuel through a force air system communicating with said eductor nozzles.

5. The improvement as defined in claim 3 wherein said eductor nozzles communicate with a flue gas recirculation chamber such that flue gas from combustion is recirculated to said eductor nozzles for mixing with combustion fuel within said eductor nozzles.

6. The improvement as defined in claim 3 wherein tertiary combustion air is supplied to a final combustion zone axially spaced from said primary combustion zone.

7. The improvement as defined in claim 6 wherein said means for controlling the volume of air flowing into the central air passage comprises a control damper whereby variance of air flow into the central air passage varies the volumes of secondary and tertiary air flow to vary the combustion mix within said primary and final combustion zones.

8. The improvement as defined in claim 7 wherein said burner includes a refractory throat formed of replaceable refractory materials, said refractory materials radiating heat to raise the temperature of said tertiary combustion air for improved combustion.

9. The improvement as defined in claim 2 wherein the central air passage is formed by a cylindrical housing, said housing being insertable into a conventional burner housing radially inwardly of the fuel spuds of the conventional burner thereby converting the conventional burner to a reduced $NO_x$ emission burner.

10. The improvement as defined in claim 7 wherein the volume of combustion air into said central air passage, the position of said spin vane within said central air passage, the pitch angle of said blades of said vane diffuser, and the eduction mix through said nozzles are independently varied to optimize combustion while reducing $NO_x$ emissions from the burner.

11. A burner adapted to reduce emission of $NO_x$ gases upon combustion of a fuel and air, the burner including a source of combustion fuel, said burner comprising:

a central air passage communicating with the source of combustion air, the volume of primary combustion air flowing into said central air passage controlled by damper means;

a vane diffuser positioned within said central air passage for imparting a mix rotation on the primary air flowing through said central air passage, said vane diffuser axially adjustable within the central air passage;

a plurality of eductor nozzles radially spaced about said central air passage downstream of said vane diffuser, said eductor nozzles in fluid communication with said source of combustion fuel and a secondary flow of combustion air to direct a fuel/air mix into said central air passage for combustion within a primary combustion zone; and a tertiary air passage directing a tertiary flow of combustion air past a refractory throat for combustion within a final combustion zone;

wherein said damper means for controlling the volume of primary air into said central air passage and the axial position of said vane diffuser within said central air passage relative to eductor nozzles are varied to optimize combustion within said burner while reducing $NO_x$ emissions.

12. The burner as defined in claim 11 wherein said eductor nozzles comprise a central passageway through which combustion fuel flows and at least one lateral port for introduction of secondary combustion air into said central passageway for mixing with the combustion fuel, said fuel/air mix being directed into said primary combustion zone.

13. The burner as defined in claim 12 wherein the size of said at least one lateral port is altered to vary the fuel/air mix directed into said primary combustion zone thereby controlling the temperature of the combustion flame.

14. The burner as defined in claim 11 wherein said vane diffuser includes a plurality of angularly adjustable blades, the angle of said blades being adjustable to vary the mix rotation imparted on the primary air flowing through said central air passage.

15. The burner as defined in claim 11 wherein said damper means includes adjustable louvers for controlling the volume of flow into said central passage whereby adjustment of said primary air flow into said central passage correspondingly varies said secondary air flow to said eductor nozzles and said tertiary air flow to said refractory throat.

16. In a conventional burner having a burner chamber with a plurality of fuel spuds radially spaced within the burner chamber for supplying combustion gas to the burner chamber and a source of combustion air supplied to the burner chamber for mix with the combustion gas, the improvement comprising:

a retrofit insert for converting the conventional burner to a low $NO_x$ burner, said insert received within the burner chamber radially inwardly of the fuel spud and including a housing forming a central air passage and an outer annulus, a duct for supplying combustion air to said central air passage, and means for directing combustion gas into said air passage, said central air passage having a vane diffuser positioned therein for imparting a mix rotation on the combustion air flowing through the central air passage, said vane diffuser axially adjustable within said central air passage to vary the distance between said diffuser and said means for directing combustion gas into said central air passage thereby optimizing mix of combustion gas and combustion air, said duct for supplying air to said central air passage having means for selectively varying the volume of combustion air flowing into said central air passage and said outer annulus whereby said mix rotation and said combustion air volume may be selectively varied to optimize combustion and reduce $NO_x$ emissions.

17. The improvement as defined in claim 16 wherein said means for directing combustion gas to said central air passage includes a burner manifold comprising a corresponding plurality of inwardly extending fuel cells communicating with the fuel spuds, said fuel cells supplying combustion gas to said central air passage for mix with said combustion air and combustion within a primary combustion zone.

18. The improvement as defined in claim 17 wherein said vane diffuser includes a plurality of blades, the pitch angle of said blades being adjustable to optimize mix rotation of combustion air for combination with combustion gas, said central air passage having a greater diameter than said vane diffuser to form an annulus between said housing and said vane diffuser.

19. The improvement as defined in claim 18 wherein the volume of combustion air into said central air passage, the position of said vane diffuser within said central air passage, and the pitch angle of said blades of said diffuser are independently varied to optimize combustion within said converted burner while reducing $NO_x$ emissions from the burner.

20. The improvement as defined in claim 16 wherein said means for selectively varying the volume of combustion air comprises a damper, said damper controlling the supply of primary combustion air flowing into said central air passage for mix with combustion gas and combustion in a primary combustion zone and the supply of secondary combustion air flowing through said outer annulus for combination in a secondary combustion zone.

21. In a conventional burner having a burner chamber with a plurality of fuel spuds for supplying combustion fuel to the burner chamber and a source of combustion air supplied to the burner chamber, the improvement comprising:

a retrofit assembly for converting the conventional burner to a low $NO_2$ burner, said assembly received within the burner chamber and including:

(a) a central housing coaxially positioned within the burner chamber radially inwardly of the fuel spuds, said central housing forming a central air passage and an outer annulus;

(b) means for directing primary combustion air into said central air passage and secondary combustion air into said outer annulus;

(c) a vane diffuser positioned within said central air passage and including a plurality of vane blades for imparting a mix rotation on the primary combustion air flowing through said central air passage; and (d) means for directing combustion fuel from the fuel spuds in said outer annulus towards said central air passage downstream of said vane diffuser for mixing with the primary combustion air from said vane diffuser and combustion in a primary combustion zone;

said vane diffuser axially adjustable within said central housing to vary the distance between said vane diffuser and said means for directing combustion fuel into said central air passage thereby optimizing mix and combustion of combustion fuel and primary combustion air in the primary combustion zone.

22. The improvement as defined in claim 21 and further comprising damper means for controlling the volume of flow of primary combustion air into said central air passage and secondary combustion air into said outer annulus, said secondary combustion air circumventing said central housing for combustion within a secondary combustion zone downstream of said primary combustion zone.

23. The improvement as defined in claim 22 wherein said blades of said vane diffuser being angularly adjustable to optimize rotational mix of primary combustion air with combustion fuel.

24. A process for optimizing combustion within a burner while reducing $NO_x$ emissions as a result of combustion, the burner including a central air passage and at least one outer annulus through which combustion air is supplied, the volume of combustion air flowing into the central air passage and the at least one outer annulus controlled by dampers, the central air passage having a vane diffuser disposed therein for imparting a mix rotation on the combustion air flowing therethrough, the vane diffuser axially adjustable within the central air passage and including a plurality of angularly adjustable blades, the processing comprising:

introducing combustion fuel into the central air passage through a plurality of nozzles radially spaced about the central air passage;

adjusting the dampers to vary the volume of combustion air flowing into the central air passage;

axially adjusting the position of the vane diffuser within the central air passage relative to a primary combustion zone to optimize the mix rotation imparted on the combustion air prior to engaging the primary combustion zone;

adjusting the angle of the diffuser blades to vary the mix rotation imparted on the combustion air;

wherein said adjustments are varied to optimize combustion within the burner while reducing $NO_x$ emissions in accordance with the combustion demand levels of the burner.

25. The process as defined in claim 24 wherein said damper, said position of the vane diffuser and said angle of said diffuser blades are adjusted automatically in response to burner demand levels to optimize combustion within the burner while reducing $NO_x$ emissions.

26. The process as defined in claim 25 wherein adjustment of the damper to vary the volume of combustion air flowing into the central air passage correspondingly varies the volume of combustion air flowing into said at least one outer annulus, the combustion air flowing into said at least one outer annulus circumventing the central air passage for combustion in subsequent combustion zones of the burner.

27. A method for converting a conventional burner to a low $NO_x$ burner, the conventional burner having a burner chamber, a plurality of fuel spuds radially spaced within the burner chamber for supplying combustion fuel to the burner chamber, and a supply of combustion air, comprising the steps of:

inserting an inner housing within the burner chamber radially inwardly of the fuel spuds, said housing forming a central air passage and an outer annulus within which the fuel spuds are disposed;

directing primary combustion air into said central air passage and secondary combustion air into said outer annulus;

inserting a vane diffuser within said inner housing to impart a rotational mix upon primary combustion air flowing through said central air passage;

installing means for directing combustion fuel from the fuel spuds into said central air passage downstream of said vane diffuser for mixture of combustion fuel with primary combustion air and a combustion within a primary combustion zone;

adjusting the axial position of said vane diffuser relative to said means for directing combustion fuel to impart an optimal rotational mix upon primary combustion air prior to combustion within the primary combustion zone.

28. The method as defined in claim 27 and further comprising the step of adjusting the angle of vane blades of said vane diffuser to vary the rotational mix imparted upon the primary combustion air.

29. The method as defined in claim 27 and further comprising the step of adjusting the ratio of primary combustion air flowing into said central air passage to secondary combustion air flowing into said outer annulus, said secondary combustion air circumventing the primary combustion zone for combustion in a subsequent combustion zone.

* * * * *